US010657941B2

(12) United States Patent
Ishioka

(10) Patent No.: US 10,657,941 B2
(45) Date of Patent: May 19, 2020

(54) ELECTRONIC MUSICAL INSTRUMENT AND LESSON PROCESSING METHOD FOR ELECTRONIC MUSICAL INSTRUMENT

(71) Applicant: CASIO COMPUTER CO., LTD., Tokyo (JP)

(72) Inventor: Yukina Ishioka, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/362,520

(22) Filed: Mar. 22, 2019

(65) Prior Publication Data

US 2019/0295518 A1 Sep. 26, 2019

(30) Foreign Application Priority Data

Mar. 23, 2018 (JP) ..... 2018-056000

(51) Int. Cl.
*G10H 1/38* (2006.01)
*G10H 1/00* (2006.01)
*G10H 1/34* (2006.01)

(52) U.S. Cl.
CPC ..... *G10H 1/38* (2013.01); *G10H 1/0066* (2013.01); *G10H 1/344* (2013.01)

(58) Field of Classification Search
CPC ..... G10H 1/38; G10H 1/344; G10H 1/0066
USPC ..... 84/613
See application file for complete search history.

(56) References Cited

U.S. PATENT DOCUMENTS 5,418,325 A * 5/1995 Aoki ..... G10H 1/383 84/613
5,936,181 A * 8/1999 Abrams ..... G10H 1/20 84/603
10,013,963 B1 * 7/2018 Ka ..... G10H 1/38
2006/0075881 A1 * 4/2006 Streitenberger ..... G10H 1/0008 84/609
2015/0317965 A1 * 11/2015 Horvath ..... G06F 16/00 84/609

FOREIGN PATENT DOCUMENTS

JP S60-46432 B2 10/1985
JP 2010-156991 A 7/2010
JP 2015-81982 A 4/2015

* cited by examiner

*Primary Examiner* — Jeffrey Donels
(74) *Attorney, Agent, or Firm* — Chen Yoshimura LLP

(57) ABSTRACT

An electronic musical instrument includes a memory storing a musical piece data that includes a first note or chord to be played by the performer at a first timing, a second note or chord to be played by the performer at a second timing, and a third note or chord to be played by the performer at a third timing and a processor that determines a target melodic interval direction from the first note or chord to the second note or chord, and that causes an automatic accompaniment to output from the second timing to a point in time immediately prior to the third timing even if the performer performs a wrong note as the second note as long as a melodic interval direction actually performed by the performer matches the target melodic interval direction.

8 Claims, 7 Drawing Sheets

ELECTRONIC MUSICAL INSTRUMENT AND LESSON PROCESSING METHOD FOR ELECTRONIC MUSICAL INSTRUMENT

BACKGROUND OF THE INVENTION

Field of the Invention

The present invention relates to an electronic musical instrument and a lesson processing method for an electronic musical instrument.

Description of Related Art

Previously, electronic musical instruments have been proposed in which, in an easy lesson mode, a keyboard operation element (key) is pressed to play automatic accompaniment of musical piece data.

However, in such electronic musical instruments, automatic accompaniment of musical piece data would be performed no matter which keyboard operation element the user pressed, which meant that the lesson would be too easy for a beginner performer and meant that the user would not achieve the sensation of performing (feeling of melodic intervals).

As a measure to eliminate such a problem, an electronic musical instrument is proposed that, during lesson mode, sequentially displays, through a display means, the keyboard operation elements that the user should specify according to the musical piece data stored in advance in the electronic musical instrument (see Patent Document 1).

Patent Document 1: Japanese Patent Application Laid-Open Publication No. S56-27189

However, in the electronic musical instrument disclosed in Patent Document 1, if a keyboard operation element is mistakenly pressed during lesson mode, automatic accompaniment of the musical piece data stops, which would mean that the lesson would be too difficult for the user, resulting in the user being difficult to obtain the feeling of melodic intervals and not being able to enjoy the lesson.

The present invention takes into consideration such a problem, and has the advantageous effect of providing an electronic musical instrument including a lesson mode in which the user can attain the feeling of melodic intervals with ease, and an electronic musical instrument lesson processing method.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument, including: a plurality of operation elements to be played by a performer, respectively specifying a plurality of notes of different pitches; a memory having stored thereon a musical piece data of a musical piece, the musical piece data including data of a first note or chord that is to be played by the performer at a first timing of the musical piece, data of a second note or chord that is to be played by the performer at a second timing that follows the first timing of the musical piece, and data of a third note or chord that is to be played by the performer at a third timing that follows the second timing of the musical piece, the first through third notes or chords being included in the plurality of notes that can be specified by the plurality of operation elements, the musical piece data further including data of an accompaniment that accompanies the first, second and third notes or chords to be played by the performer; and at least one processor, wherein the at least one processor executes an accompaniment playback process that includes the following: determining a target melodic interval direction from the first note or chord towards the second note or chord by referencing to the musical piece data, the determined target melodic interval direction being one of ascending, descending, and equal; determining a performed melodic interval direction by referencing to an operation element or a group of operation elements, among the plurality of operation elements, that is specified by the performer at the second timing relative to an operation element or a group of operation elements, among the plurality of operation elements, that was specified by the performer at the first timing or relative to said first note or chord that was to be played by the performer at the first timing, the determined performed melodic interval direction being one of ascending, descending, and equal; causing musical sound of the accompaniment to output based on the musical piece data from the second timing to a point in time immediately prior to the third timing only when the performed melodic interval direction matches the target melodic interval direction; and causing the musical sound of the accompaniment not to output from the second timing to the point in time immediately prior to the third timing when the performed melodic interval direction does not match the target melodic interval direction, wherein in determining the target melodic interval direction, the at least one processor compares a pitch of the second note, or a representative pitch of the second chord in case of chord, with a pitch of the first note, or a representative pitch of the first chord in case of chord, so as to determine a direction of pitch change from the first note or code to the second note or code in the musical piece, and wherein in determining the performed melodic interval direction, the at least one processor compares a pitch of the operation element or a representative pitch of the group of operation elements that is specified by the performer at the second timing with a pitch of the operation element, or a representative pitch of the group of operation elements, that was specified by the performer at the first timing or with the pitch of the first note, or the representative pitch of the first chord in case of chord, that was to be played at the first timing so as to determine a direction of pitch change from a note or code that was actually specified by the performer or that should have been specified by the performer at the first timing to a node or code that is specified by the performer at the second timing.

In another aspect, the present disclosure provides a method to be performed by at least one processor in an electronic musical instrument that includes, in addition to said at last one processor: a plurality of operation elements to be played by a performer, respectively specifying a plurality of notes of different pitches; and a memory having stored thereon a musical piece data of a musical piece, the musical piece data including data of a first note or chord that is to be played by the performer at a first timing of the musical piece, data of a second note or chord that is to be played by the performer at a second timing that follows the first timing of the musical piece, and data of a third note or chord that is to be played by the performer at a third timing that follows the second timing of the musical piece, the first through third notes or chords being included in the plurality of notes that can be specified by the plurality of operation elements, the musical piece data further including data of an accompaniment that accompanies the first, second and third notes or chords to be played by the performer, the method comprising, via said at least one processor: determining a target melodic interval direction from the first note or chord towards the second note or chord by referencing to the musical piece data, the determined target melodic interval direction being one of ascending, descending, and equal; determining a performed melodic interval direction by referencing to an operation element or a group of operation elements, among the plurality of operation elements, that is specified by the performer at the second timing relative to an operation element or a group of operation elements, among the plurality of operation elements, that was specified by the performer at the first timing or relative to said first note or chord that was to be played by the performer at the first timing, the determined performed melodic interval direction being one of ascending, descending, and equal; causing musical sound of the accompaniment to output based on the musical piece data from the second timing to a point in time immediately prior to the third timing only when the performed melodic interval direction matches the target melodic interval direction; and causing the musical sound of the accompaniment not to output from the second timing to the point in time immediately prior to the third timing when the performed melodic interval direction does not match the target melodic interval direction, wherein in determining the target melodic interval direction, the method causes the at least one processor to compare a pitch of the second note, or a representative pitch of the second chord in case of chord, with a pitch of the first note, or a representative pitch of the first chord in case of chord, so as to determine a direction of pitch change from the first note or code to the second note or code in the musical piece, and wherein in determining the performed melodic interval direction, the method causes the at least one processor to compare a pitch of the operation element or a representative pitch of the group of operation elements that is specified by the performer at the second timing with a pitch of the operation element, or a representative pitch of the group of operation elements, that was specified by the performer at the first timing or with the pitch of the first note, or the representative pitch of the first chord in case of chord, that was to be played at the first timing so as to determine a direction of pitch change from a note or code that was actually specified by the performer or that should have been specified by the performer at the first timing and a node or code that is specified by the performer at the second timing.

It is to be understood that both the foregoing general description and the following detailed description are exemplary and explanatory, and are intended to provide further explanation of the invention as claimed.

BRIEF DESCRIPTION OF THE DRAWINGS

The present invention will be more understood with reference to the following detailed descriptions with the accompanying drawings.

DETAILED DESCRIPTION OF THE PREFERRED EMBODIMENTS

Figure 1:
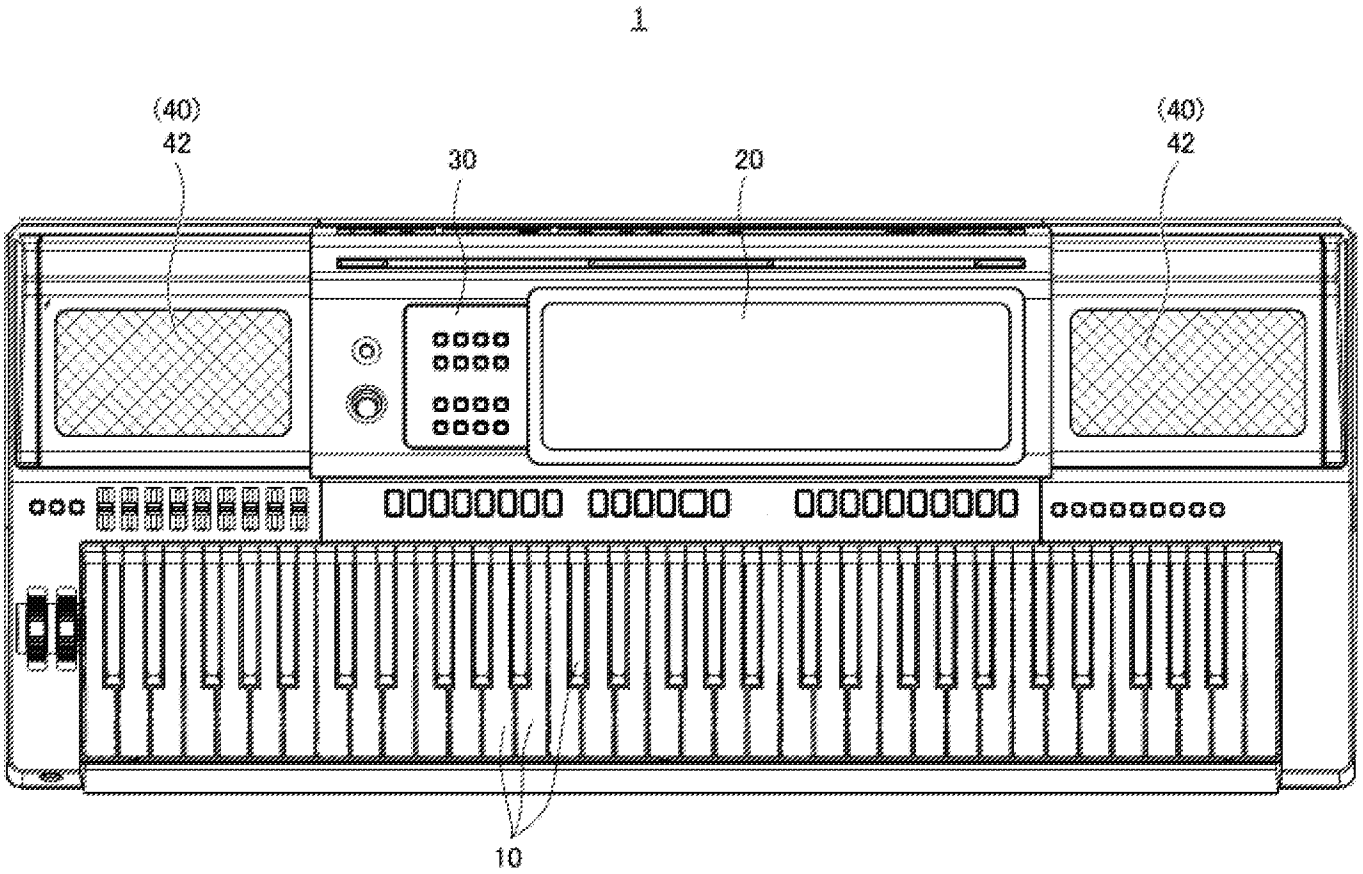
FIG. 1 is a plan view showing an electronic musical instrument according to the embodiment of the present invention.

An electronic musical instrument according to an embodiment of the present invention (hereinafter referred to as "the present embodiment") will be explained below with reference to the drawings. The same elements are assigned the same reference characters throughout the embodiment of the present specification.

Configuration of Electronic Musical Instrument

A detailed configuration of an electronic musical instrument 1 of the present embodiment will be described below with reference to FIGS. 1 to 3.

Figure 2:
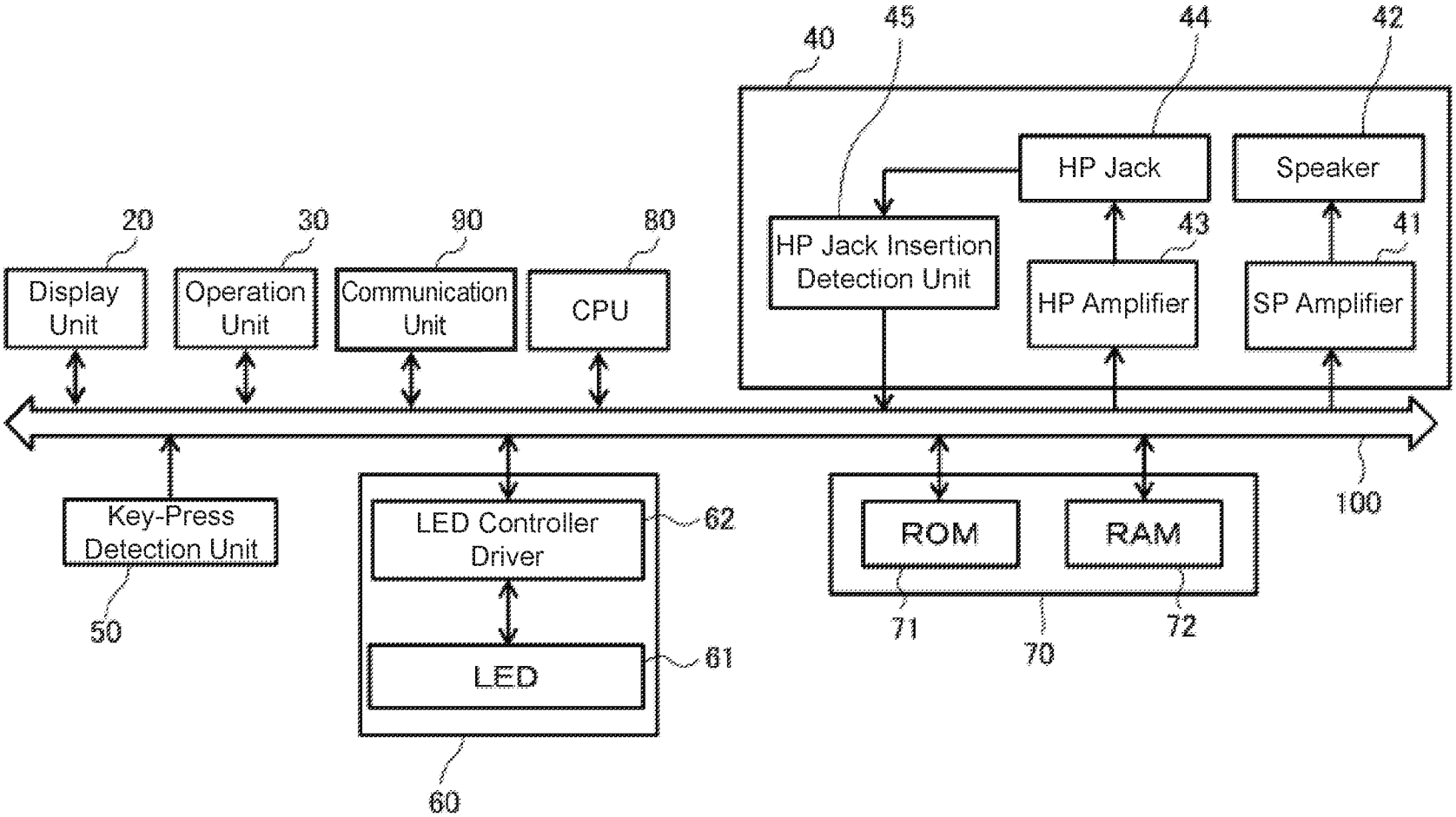
FIG. 2 is a block diagram showing the internal configuration of the electronic musical instrument according to an embodiment of the present invention.
Figure 3:
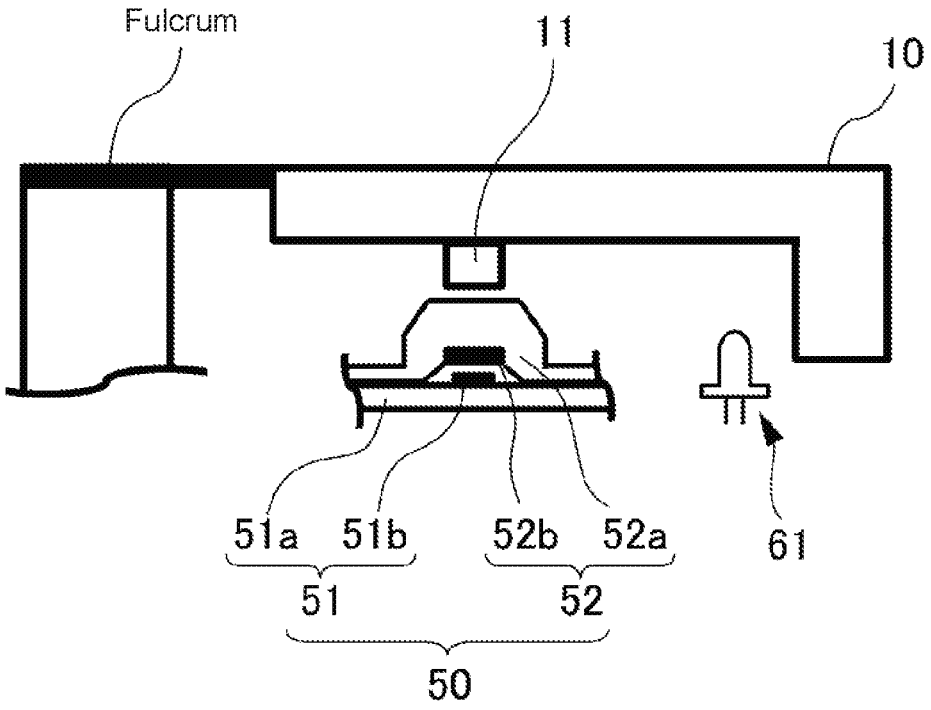
FIG. 3 is a partial cross-sectional view of the vicinity of a keyboard of the electronic musical instrument, passing through the center of the keyboard.

FIG. 1 is a plan view showing the electronic musical instrument 1 according to an embodiment of the present invention, FIG. 2 is a block diagram for showing the internal configuration of the electronic musical instrument 1 of FIG. 1, and FIG. 3 is a partial cross-sectional view of the vicinity of a keyboard 10 of the electronic musical instrument 1, passing through the center of the keyboard 10.

As shown in FIG. 1, the electronic musical instrument 1 according to the present embodiment is, for example, an electronic piano, a synthesizer, an electronic organ, or the like, and includes a keyboard 10 having a plurality of operation elements, a display unit 20, and an operation unit 30.

As shown in FIG. 2, the electronic musical instrument 1 includes a sound output unit 40, a key-press detection unit 50, a guide unit 60, a memory 70, a CPU 80 (computer), and a communication unit 90.

The keyboard 10 is for indicating to the electronic musical instrument 1 whether to play a sound or stop playing a sound when a performer is performing.

The display unit 20 has a liquid crystal monitor equipped with a touch panel, for example, and displays a message when a performer operates the operation unit 30, displays a screen for selecting a lesson mode to be described later, or the like.

In the present embodiment, the display unit 20 has a touch panel function, and thus, can handle some of the functions of the operation unit 30.

The operation unit 30 has operation buttons used by the performer to configure various settings and the like, and a power switch that switches the power of the electronic musical instrument 1 on or off. The operation buttons are for configuring various settings and the like such as selecting whether or not to use a lesson mode and adjusting the sound volume.

The sound output unit 40 outputs sound, and has an SP amplifier 41 (speaker amplifier), a speaker 42, an HP amplifier 43 (headphone amplifier), an HP jack 44 (headphone jack) into which a headphone plug is to be inserted, and an HP jack insertion detection unit 45 that detects that a headphone plug has been inserted into the HP jack 44.

When the headphone plug is inserted into the HP jack 44, the HP jack insertion detection unit 45 detects that the plug has been inserted, and sound is outputted to the HP jack, but if the HP jack insertion detection unit 45 does not detect that a headphone plug has been inserted, then the sound is outputted to the speaker.

The key-press detection unit 50 is for detecting that the operation element of the keyboard 10 has been pressed, and is constituted of a rubber switch as shown in FIG. 3.

Specifically, the key-press detection unit 50 includes a circuit board 51 provided with a tooth-shaped switch contact points 51*b* on a substrate 51*a*, and a dome rubber 52 that is disposed over the circuit board 51, for example.

The dome rubber 52 includes a dome portion 52*a* that is arranged so as to cover the switch contact points 51*b*, and a carbon surface 52*b* that is provided on the surface of the dome portion 52*a* facing the switch contact points 51*b*.

When a performer presses the operation element of the keyboard 10, the keyboard 10 moves towards the dome portion 52*a* about a fulcrum, the dome portion 52*a* is pressed towards the circuit board 51 by a protrusion 11 provided at a position on the keyboard 10 facing the dome portion 52*a*, and when the dome portion 52*a* undergoes buckling deformation, the carbon surface 52*b* abuts the switch contact points 51*b*.

As a result, the switch contact points 51*b* are short-circuited, i.e., electrically connected, and a key-press operation on the operation element of the keyboard 10 is detected.

Conversely, if the performer stops pressing the operation element of the keyboard 10, the operation element of the keyboard 10 returns to the state shown in FIG. 3 prior to being pressed and the dome portion 52*a* also returns to its original state, causing the switch contact points 51*b* to separate from the carbon surface 52*b*.

As a result, the switch contact points 51*b* are disconnected, and a key-release operation on the operation element of the keyboard 10 is detected.

This key-press detection unit 50 is provided for each operation element of the keyboard 10.

The guide unit 60 is for visually indicating the operation element of the keyboard 10 to be pressed by the performer when a lesson mode is selected.

Thus, in the present embodiment, as shown in FIG. 2, the guide unit 60 includes LEDs 61, and an LED controller driver 62 that controls the LEDs 61 so as to be on/off or the like.

This LED 61 is provided for each operation element of the keyboard 10, and the portion of each operation element facing the LED 61 is configured to allow light to pass through.

The memory 70 includes a ROM 71 that is a read-only memory, and a RAM 72 that is a read/write memory.

The ROM 71 stores control programs (lesson mode programs and the like to be mentioned later) executed by the CPU 80, various data tables, and the like, for example.

The RAM 72 stores pitch data corresponding to each operation element, musical piece data, data to be used in the lesson modes to be mentioned later, and the like.

Also, the RAM 72 functions as a temporary storage region for loading data generated by the CPU 80 during the performance and the control programs.

The CPU 80 controls the entire electronic musical instrument 1.

The CPU 80 executes an automatic accompaniment play process that, in response to the operation element of the keyboard 10 being specified (such as by a key of a keyboard being pressed), causes automatic accompaniment of the musical piece data for the corresponding lesson to play from the sound output unit 40, an automatic accompaniment stop process that, in response to the operation element of the keyboard 10 being released, stops the automatic accompaniment of the musical piece data for the corresponding lesson from being played from the sound output unit 40, or the like, for example.

Also, the CPU 80 may control the LED controller driver 62 so as to turn on/off the LEDs 61 on the basis of data used during the lesson mode.

The communication unit 90 includes a wireless unit or a wired unit to communicate with an external device, and data can be transmitted/received to/from the external device through the communication unit 90.

The components described above (display unit 20, operation unit 30, sound output unit 40, key-press detection unit 50, guide unit 60, memory 70, CPU 80, and communication unit 90) are connected to each other by a bus 100 so as to enable communication therebetween, enabling necessary data to be exchanged between the components.

Next, a lesson mode included in the electronic musical instrument 1 will be described.

The lesson mode is a mode to be used when practicing performance along with musical piece data stored in the RAM 72 in advance.

As described above, the RAM 72 has stored in therein data to be used during the lesson mode, and when a lesson mode is selected, the CPU 80 determines whether or not the performer has specified an operation element (e.g., pressed a key of a keyboard) so as to satisfy prescribed conditions to be described later on the basis of the lesson mode musical piece data and the lesson mode program, and determines whether or not to play the automatic accompaniment of the musical piece data on the basis of the determination results.

Lesson Mode Process

A lesson mode process will be described in detail below with reference to FIGS. 4 to 7.

Main Process

First, a main process of the lesson mode will be described with reference to FIG. 4.

Figure 4:
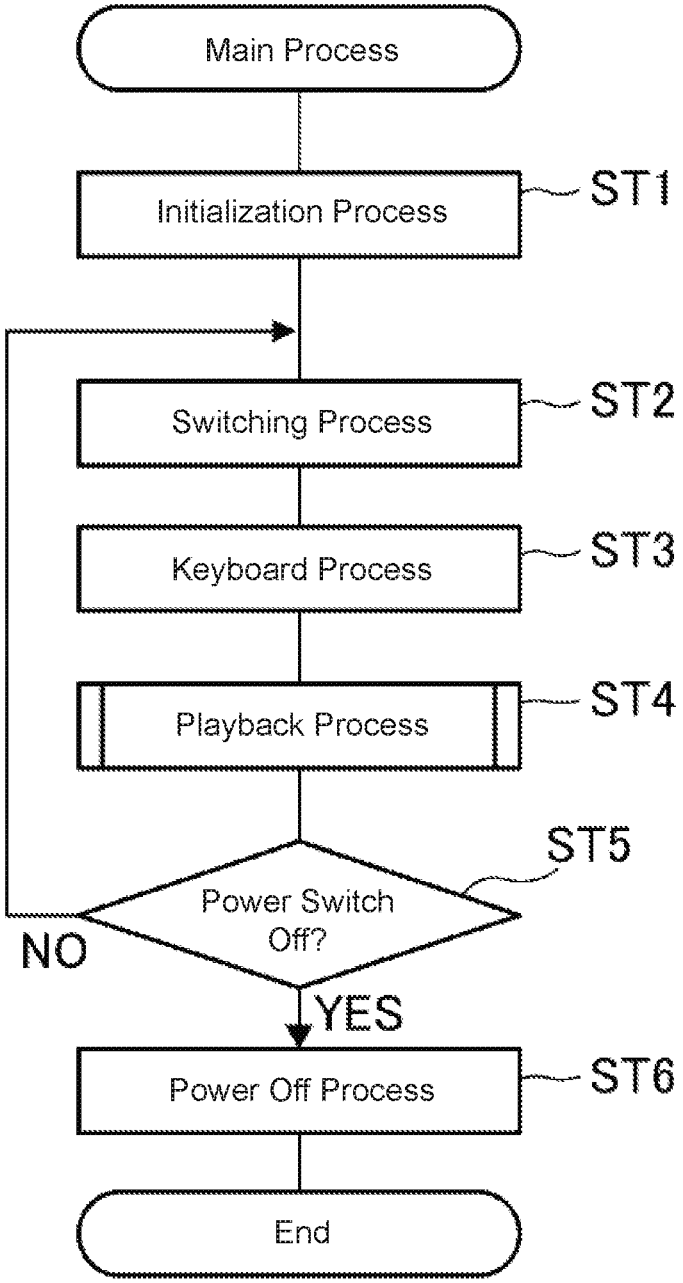
FIG. 4 is a flowchart showing a main process of a lesson mode of the electronic musical instrument.

FIG. 4 is a flowchart showing a main process of a lesson mode of the electronic musical instrument 1.

When the performer turns on the electronic musical instrument 1, the CPU 80 is started up and the process progresses to step ST1.

In step ST1, the CPU 80 performs an initialization process on previous performance information (tone color, tempo, etc., for example) stored temporarily in the RAM 72, and progresses to step ST2.

Next, in step ST2, the CPU 80 monitors whether the performer has operated an operation button of the operation unit 30 or a touch panel, performs a switching process according to the monitoring results, and progresses to step ST3.

If the lesson mode and musical piece for the lesson are selected by an operation by the performer, the switching process corresponding to the selection is performed, thereby starting the lesson for the selected musical piece, and then the process progresses to step ST3.

Next, in step ST3, the key-press detection unit 50 detects the key-press operation (note-on) and the key-release operation for the operation element of the keyboard 10, and the process progresses to step ST4.

Next, in step ST4, the CPU 80 performs a playback process for the automatic accompaniment of the musical piece data for the musical piece selected on the basis of the key-press operation and key-release operation of the operation element of the keyboard 10 detected by the key-press detection unit 50, and progresses to step ST5.

The musical piece data of the selected musical piece includes at least data indicating a first pitch (first note) to be played, data indicating a second pitch (second note) to be played after the first pitch/note, and data indicating a third pitch (third note) to be played after the second pitch/note.

Details of the playback process of step ST4 will be described later.

Next, in step ST5, the CPU 80 determines whether or not the power switch of the operation unit 30 has been switched to off.

If the power switch of the operation unit 30 is switched to off (YES), then the process progresses to step ST6, and if the power switch of the operation unit 30 remains on (NO, that is, the power switch of the operation unit 30 has not been switched to off), then the process returns to the switching process (step ST2).

Lastly, if the result of step ST5 is YES, then in step ST6, the CPU 80 performs a power off process, thereby ending the main process.

Playback Process

Next, a playback process in the main process will be described with reference to FIG. 5.

Figure 5:
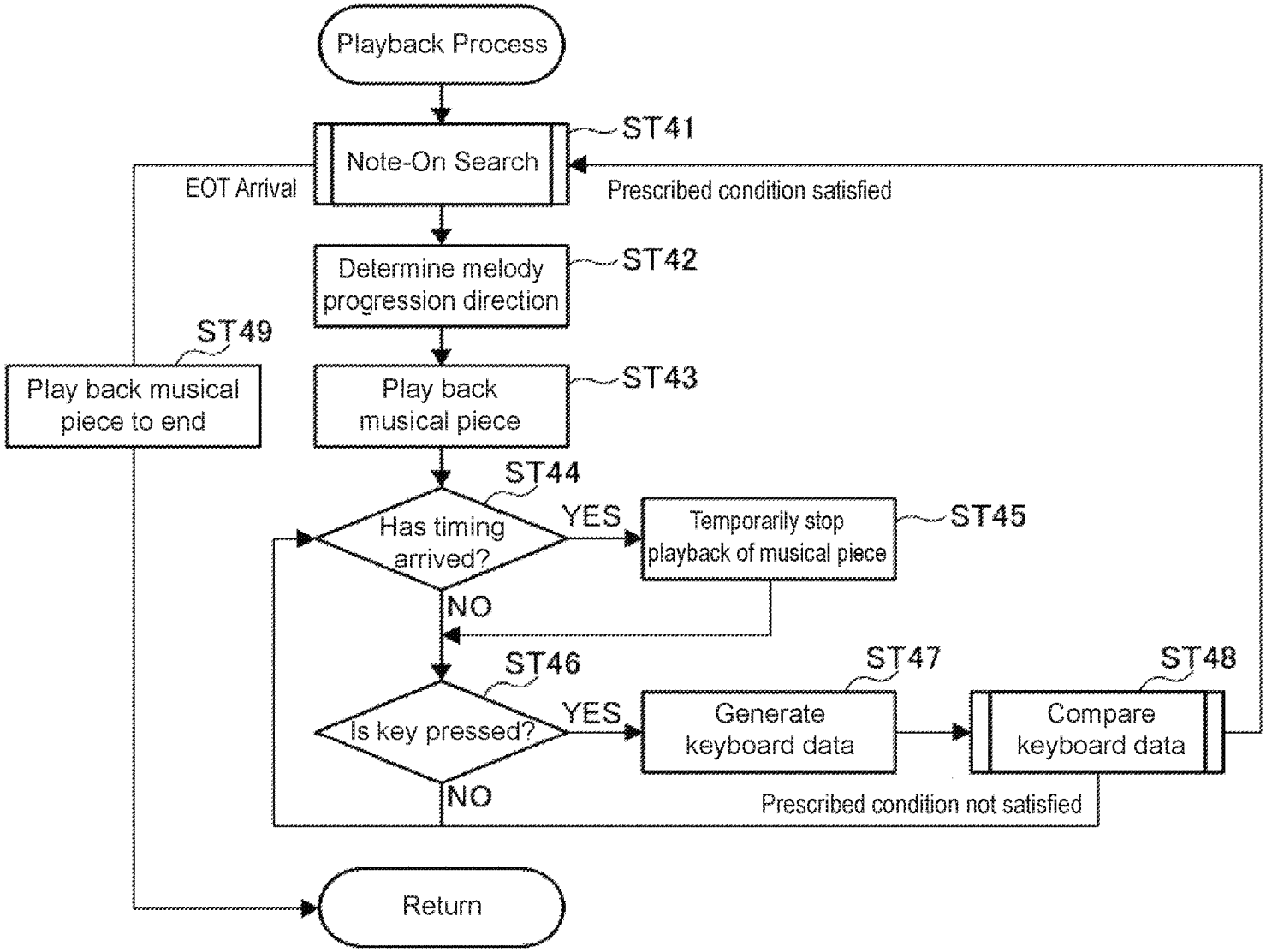
FIG. 5 is a flowchart showing a playback process in the main process of the electronic musical instrument.

FIG. 5 is a flowchart showing a playback process (step ST4) in the main process of the electronic musical instrument 1.

First, in step ST41, the CPU 80 performs a current note-on search process from the musical piece data for the selected lesson. If the read command is not a track end command EOT, then the CPU 80 reads a command (hereinafter referred to as a note-on command) corresponding to the pitch/note (current pitch/note to be played/second pitch/note) to be played after the pitch (first pitch/note) that was to be previously played, determines a current step time to be described later, and the process progresses to step ST42. If the command is the track end command EOT, the process moves to step ST49.

Details of the note-on search process (current) will be described later.

In step ST49, which is branched off from step ST41, the CPU 80 causes the automatic accompaniment of the musical piece data to be played back (progress) to the end, and then returns to the main process.

Next, in step ST42 (direction determination process), the CPU 80 determines the current melody progression direction on the basis of the pitch (note) that was to be previously played (first pitch/note) (regardless whether it has been actually specified and played) and the pitch (note) that should be currently played (second pitch/note), and the process progresses to step ST43.

Here, the current melody progression direction is the target melodic interval direction from the note (pitch) that was to be previously played (first pitch/note) to the pitch (note) to be currently played (second pitch/note).

However, if there is no pitch/note that was to be previously played (first pitch/note) and the pitch to be currently played (second pitch/note) is the very first note for the performer to play after the performance has begun, then there is deemed to be no melody progression direction.

If the musical piece data includes data indicating one pitch/note that was to be previously played (first pitch/note) and data indicating one pitch/note to be currently played (second pitch/note), then the current melody progression direction (target melodic interval direction) is determined on the basis of a note number that is the data indicating the pitch to be currently played (second pitch/note) and a note number that is the data indicating the pitch that was to be played previously (first pitch/note).

Specifically, in the keyboard 10 of FIG. 1, when a note number that is data indicating the current pitch/note to be played (second pitch/note), such as a MIDI note number, is to the right of (i.e., greater than, in case of MIDI note number) a note number that is data indicating the pitch that was to be played previously (first pitch/note) (the key corresponding to the second pitch/note in the keyboard 10 is to the right, that is, the high pitch side of the key corresponding to the first pitch/note in case of keyboard), the current melody progression direction is in the ascending melodic interval direction; when the note number that is data indicating the current pitch/note to be played (second pitch/note) is to the left of the note number that is data indicating the pitch that was to be played previously (first pitch/note) (the key corresponding to the second pitch/note in the keyboard 10 is to the left, that is, the low pitch side of the key corresponding to the first pitch/note), the current melody progression direction is in the descending melodic interval direction; and when the note number that is data indicating the current pitch to be played (second pitch/note) is the same as the note number that is data indicating the pitch that was to be played previously (first pitch/note), there is deemed to be no melody progression direction.

In other words, the CPU 80 determines that, if the note number indicating the current pitch to be played (second note number) is at a greater value than the note number (first note number) indicating the pitch that should have been previously played, the melody is in the ascending melodic interval direction.

Also, the CPU 80 determines that, if the note number indicating the current pitch to be played (second note number) is at a lesser value than the note number (first note number) indicating the pitch that was to be played previously, the melody is in the descending melodic interval direction.

Additionally, the CPU 80 determines that, if the note number indicating the current pitch to be played (second note number) is at the same value as the note number (first note number) indicating the pitch to have been previously played, the melody has no direction.

Also, if the musical piece data includes data indicating one pitch/note that was to be played previously (first pitch/note) and data indicating a plurality of pitches to be currently played (second pitches/notes; chord), then the current melody progression direction is determined on the basis of a note number that is data indicating the pitch that was to be played previously (first pitch/note) and an average value of note numbers that constitute data indicating the plurality of current pitches to be played (second pitches/notes; chord).

In other words, the CPU 80 determines that, if the average value of a plurality of differing note numbers indicating a plurality of pitches/notes to be currently played (plurality of differing second note numbers) is at a greater value than the note number (first note number) indicating the pitch/note that was to be played previously, the melody is in the ascending melodic interval direction.

Also, the CPU 80 determines that, if the average value of a plurality of differing note numbers indicating a plurality pitches to be currently played (plurality of differing second note numbers) is at a lesser value than the note number (first note number) indicating the pitch that was to be played previously, the melody is in the descending melodic interval direction.

Additionally, the CPU 80 determines that, if the average value of a plurality of differing note numbers indicating a plurality of pitches to be currently played (plurality of differing second note numbers) is at the same value as the note number (first note number) indicating the pitch that was to be played previously, the melody has no direction.

If the musical piece data includes data indicating a plurality of pitches/notes that were to be played previously (first pitches/notes; chord) and data indicating one pitch to be currently played (second pitch/note), then the current melody progression direction is determined on the basis of the average value of note numbers that constitute data indicating the pitches that were to be played previously (first pitches/notes; chord) and a note number that is data indicating the current pitch to be played (second pitch/note).

Furthermore, if the musical piece data includes data indicating a plurality of pitches that were to be played previously (first pitches/notes; chord) and data indicating a plurality of pitches to be currently played (second pitches/notes; chord), then the current melody progression direction is determined on the basis of an average value of note numbers that constitute data indicating the plurality of pitches that were to be played previously (first pitches/notes; chord) and an average value of note numbers that constitute data indicating the plurality of current pitches to be played (second pitches/notes; chord).

Next, in step ST43, the CPU 80 causes automatic accompaniment of the musical piece data to progress from the previous pitch that was to be played previously (first pitch/note) to the sound prior to the current pitch to be played (second pitch/note), thereby performing a playback of the automatic accompaniment of the previous musical piece data. Then the process progresses to step ST44.

Next, in step ST44, the CPU 80 determines whether the current time has reached a timing (hereinafter referred to as a note-on timing) at which the performer should specify the operation element corresponding to the pitch/note to be played at that timing (second pitch/note), based on the current step time determined in step ST41.

If the current time is at the note-on timing (YES), then the process progresses to step ST45, and if the current time is not at the note-on timing (NO), then the process branches off to step ST46.

Next, if the result of step ST44 is YES, then in step ST45 (automatic accompaniment stop process), the CPU 80 temporarily stops the automatic accompaniment of the musical piece data at a timing at which the operation element corresponding to the current pitch to be played (second pitch/note) should have been specified (e.g., by pressing the corresponding key), and then progresses to step ST46.

Next, in step ST46, the key-press detection unit 50 determines (detects) whether or not a key-press operation is being performed on the current operation element.

If a key-press operation is being performed on the current operation element (YES), then the process progresses to step ST47, and if a key-press operation is not being performed on the current operation element (NO), then the process returns to the determination process (step ST44) to determine arrival of the note-on timing.

Next, if the result of step ST46 is YES, then in step ST47, the CPU 80 generates current keyboard data on the basis of the key-press operation and key-release operation of the current operation element, and progresses to step ST48.

Next, in step ST48, the CPU 80 performs a current keyboard data comparison process on the basis of the current keyboard data generated in step ST47 and the current melody progression direction determined in step ST42.

If the results of the current keyboard data comparison process satisfy prescribed conditions, then the process progresses to the note-on search process (step ST41), and if the results of the keyboard data comparison process do not satisfy the prescribed conditions, then the process returns to the determination process (step ST44) to determine arrival of the note-on timing.

Details of the keyboard data comparison process and the prescribed conditions will be described later.

Note-On Search Process

Next, the note-on search process in the playback process will be described in detail with reference to FIG. 6.

Figure 6:
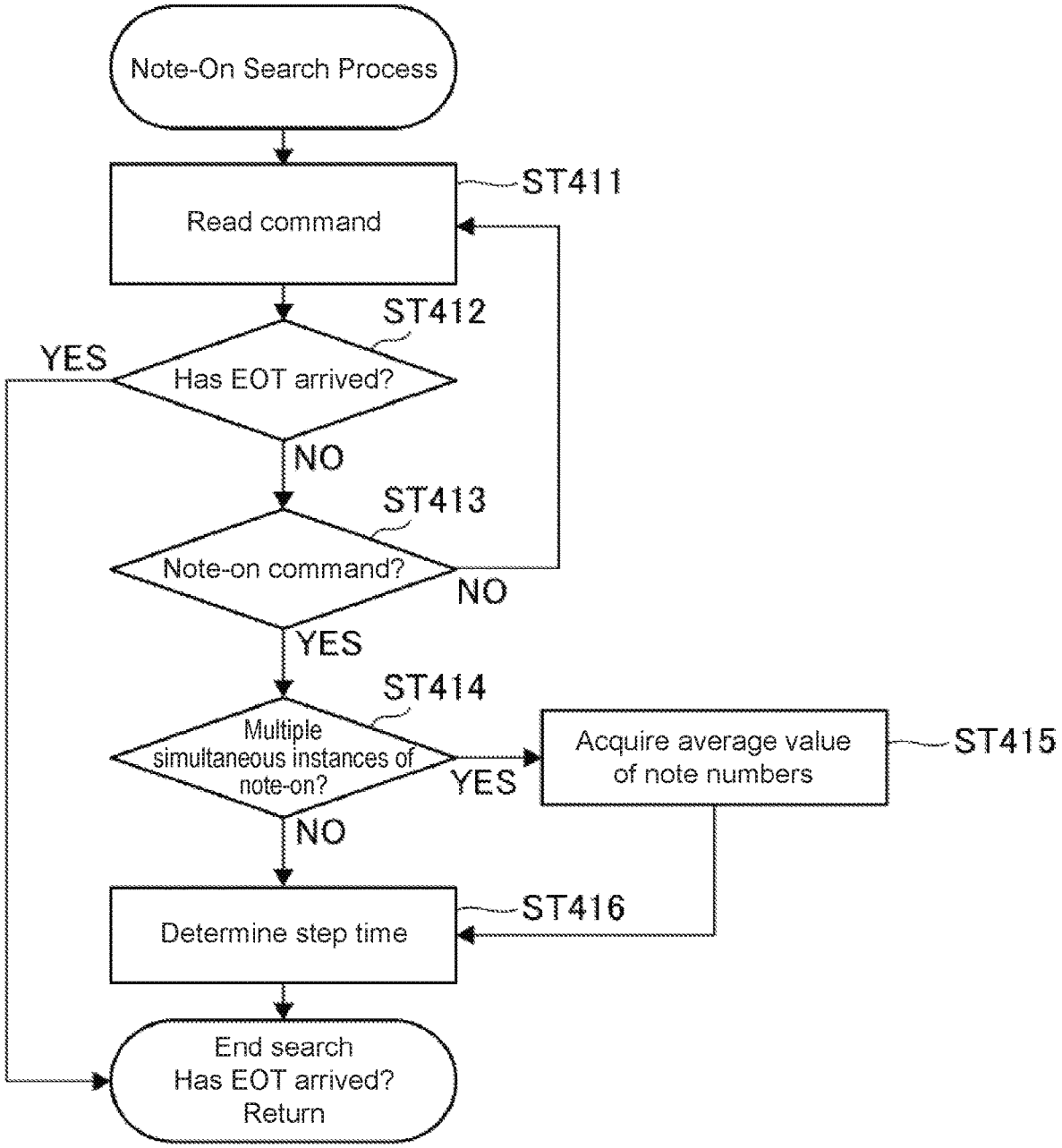
FIG. 6 is a flowchart showing a note-on search process executed in the playback process.

FIG. 6 is a flowchart showing the note-on search process (step ST41) executed in the playback process (step ST4).

First, in step ST411, the CPU 80 performs a process of reading the current command from the selected musical piece data for the lesson, and progresses to step ST412.

Next, in step ST412, the CPU 80 determines whether or not the read command is a track end command EOT.

If the read command is not the track end command EOT (NO), then the process progresses to step ST413, and if the read command is the track end command EOT (YES), then the process returns to the playback process (step ST4 in FIG. 4), and progresses to the process of playing back the musical piece to the end (step ST49 in FIG. 5).

Next, in step ST413, the CPU 80 determines whether or not the read command is a note-on command.

If the read command is the note-on command (YES), then the process progresses to step ST414, and if the read command is not the note-on command (NO), then the process returns to the command read process (step ST411).

Next, in step ST414, the CPU 80 determines whether or not there are a plurality of note-on commands at the same timing.

If there are not a plurality of note-on commands at the same timing (NO, that is, there is only one note-on command at the same timing), then the process progresses to step ST416, and if there are a plurality of note-on commands at the same timing (YES, that is, if the note-on is a chord), then the process branches off to step ST415.

Next, if the result of step ST414 is YES, then in step ST415, the CPU 80 acquires the average value of note numbers that constitute data indicating the plurality of current pitches to be played (second pitches/notes), and then progresses to step ST416.

Next, in step ST416, the CPU 80 determines a current step time, which is a time interval from a timing at which the operation element corresponding to the pitch that was to be previously played (first pitch/note) should have been specified to a timing at which the operation element corresponding to the current pitch to be played (second pitch/note) should be specified, on the basis of the note-on command timing, returns to the playback process (step ST4 in FIG. 4), and progresses to the melody progression direction determination process (step ST42 in FIG. 5).

To reiterate, the note-on command read in step ST413 is used for the determination process for the current melody progression direction (step ST42), and the current step time determined in step ST416 is used for the note-on timing arrival determination process (step ST44).

Keyboard Data Comparison Process

Next, the keyboard data comparison process in the playback process will be described in detail with reference to FIG. 7.

Figure 7:
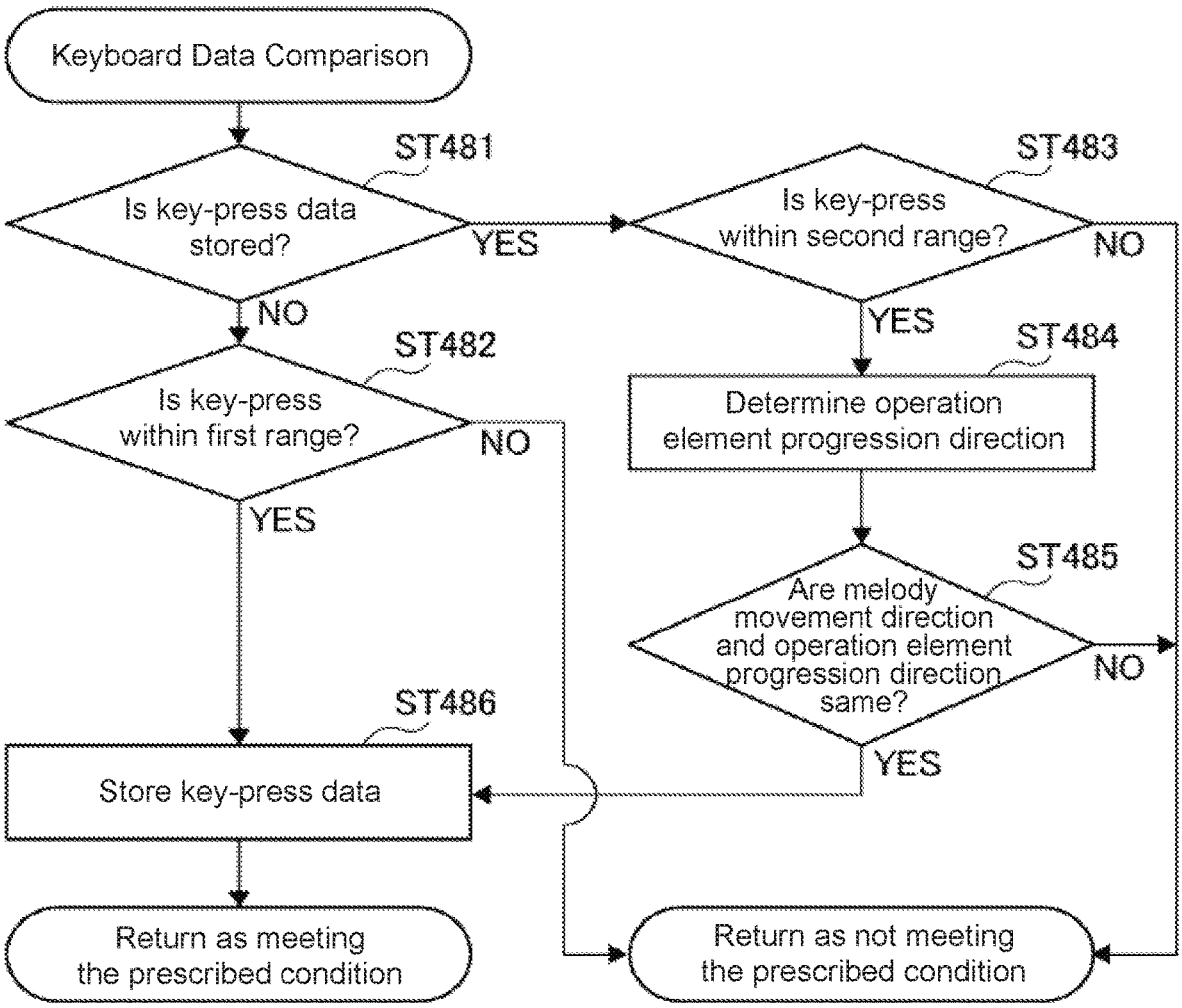
FIG. 7 is a flowchart showing a keyboard data comparison process in the playback process.

FIG. 7 is a flowchart showing the keyboard data comparison process (step ST48) executed in the playback process (step ST4).

First, in step ST481, the CPU 80 determines whether or not keyboard data previously generated in step ST47 has been temporarily stored in the RAM 72.

If the keyboard data has not been stored in the RAM 72 (NO), then the process progresses to step ST482, and if the keyboard data has been temporarily stored in the RAM 72 previously (YES), then the process branches off to step ST483.

Next, if the result from step ST481 is NO, then in step ST482 (first prescribed condition), the CPU 80 determines whether the operation element that is detected in step ST46 and therefore is currently specified is within a range that includes an operation element corresponding to the pitch to be played for the first note and that has a prescribed allowance range from that operation element to be played for the first note (below, this is referred to as a first range of allowable notes).

An example of the first range of allowable notes is a range of 10 keys (operation elements) or fewer in the higher pitch direction and 10 keys (operation elements) or fewer in the lower pitch direction from the operation element corresponding to the pitch to be played as the first note. Needless to say, the number of keys is not limited to 10, and may be any number of keys.

However, if there is data in the musical piece data indicating a plurality of pitches/notes (chord) to be played as the first notes, in step ST482, the CPU 80 determines whether or not a virtual operation element obtained by averaging the note numbers corresponding to the currently specified operation elements detected in step ST46 is within the set range. In other words, the CPU 80 determines whether or not the average value is included among note numbers within the first range.

If the currently specified operation element detected in step ST46 falls within the first range of allowable notes (YES/first prescribed condition is satisfied), then the process progresses to step ST486.

On the other hand, if the currently specified operation element detected in step ST46 does not fall within the first range of allowable notes (NO/first prescribed condition is not satisfied), then it is determined that the prescribed condition has not been met, and the process returns to the note-on timing arrival determination process (step ST44).

Next, if the result of step ST482 is YES, then in step ST486, the CPU 80 temporarily stores the current keyboard data generated in step ST47 in the RAM 72, and returns to the playback process (step ST4) as meeting the prescribed condition. Then the process progresses to the next note-on search process (step ST41).

On the other hand, if the result from step ST481 is YES, then in step ST483 (second prescribed condition), the CPU 80 determines whether the operation element detected in step ST46 is within a range that includes an operation element corresponding to the pitch to be currently played (second pitch/note) and that has a prescribed allowance range from that operation to be currently played (second pitch/note) (below, this is referred to as a second range of allowable notes).

An example of the second range of allowable notes is a range of five keys (operation elements) or fewer in the ascending melodic interval direction and five keys (operation elements) or fewer in the descending melodic interval direction from the operation element corresponding to the pitch to be currently played (second pitch/note).

However, if there is data in the musical piece data indicating a plurality of pitches (second pitches/notes; chord) to be currently played, in step ST483, the CPU 80 determines whether or not a virtual operation element obtained by averaging the note numbers corresponding to the currently specified operation elements detected in step ST46 is within the set range. In other words, the CPU 80 determines whether or not the average value is included among note numbers within the second range.

If the currently specified operation element detected in step ST46 falls within the second range of allowable notes (YES/second prescribed condition is satisfied), then the process progresses to step ST484.

If the currently specified operation element detected in step ST46 does not fall within the second range of allowable notes (NO/second prescribed condition is not satisfied), the process returns to the note-on timing arrival determination process as not meeting the prescribed condition (step ST44).

Next, if the result of step ST483 is YES, then in step ST484, the CPU 80 determines the current operation element progression direction, and progresses to step ST485.

In the present embodiment, the current operation element progression direction is a performed melodic interval direction from a pitch corresponding to an operation element or operation elements (note number or average value of note numbers) that have been previously specified and temporarily stored in the RAM 72 to a pitch corresponding to the currently specified operation element. However, the configuration is not limited thereto, and the current operation element progression direction (performed melodic interval direction) may be a melodic interval direction from a pitch that was to be previously played (first pitch/note) that is included in the musical piece data (regardless of whether the first pitch/note was actually specified and played) to the pitch currently specified by the performer.

Specifically, the CPU 80 determines the current operation element progression direction on the basis of a note number that is data indicating the current pitch being specified and a note number that is data indicating the pitch specified by the performer previously or the previous pitch that should have been played (first pitch/note) according to the musical piece data.

In the keyboard 10 of FIG. 1, when a note number that is data indicating the currently specified pitch is of a greater value than a note number that is data indicating the previously specified pitch or the previous pitch that should have been played (first pitch/note) (the currently specified key is to the right of the previously specified (or "should-have-been-specified") key on the keyboard 10), the current operation element progression direction is in the ascending melodic interval direction; when the note number that is data indicating the currently specified pitch is of a lesser value than the note number that is data indicating the previously specified pitch or the previous pitch that should have been (first pitch/note) (the currently specified key is to the left of the previously specified (or "should-have-been-specified") key on the keyboard 10), the current operation element progression direction is in the descending melodic interval direction; and when the note number that is data indicating the currently specified pitch is the same as the note number that is data indicating the previously specified pitch or the previous pitch that should have been played (first pitch/note), there is deemed to be no current operation element progression direction.

Next, in step ST485 (third prescribed condition), the CPU 80 compares the current operation element progression direction determined in step ST484 and the current melody progression direction determined in step ST42 to determine whether the two progression directions are the same.

If the current operation element progression direction is the same as the current melody progression direction (YES/third prescribed condition is satisfied), then the process progresses to step ST486, and if the current operation element progression direction is not the same as the current melody progression direction (NO/third prescribed condition is not satisfied), then the prescribed condition is deemed not to have been met, and the process returns to the note-on timing arrival determination process (step ST44).

Next, if the result of step ST485 is YES, then in step ST486, the CPU 80 temporarily stores a MIDI note number indicating the currently specified (i.e., pressed) key generated in step ST47 in the RAM 72, and progresses to the next note-on search process (step ST41) as meeting the prescribed condition.

Next Playback Process

Next, in the subsequent execution of step ST41, the CPU 80 performs the next note-on search process, which is reading a command corresponding to the next pitch to be played (next pitch to be played/third pitch) after the current pitch to be played (second pitch/note) as well as determining the next step time, and the process progresses to the subsequent execution of step ST42.

Next, in the subsequent execution of step ST42, the CPU 80 determines the next melody progression direction on the basis of the current pitch to be played (second pitch/note) and the next pitch to be played (third pitch), and the process progresses to the subsequent execution of step ST43.

Then, in the subsequent execution of step ST43, the CPU 80 causes automatic accompaniment of the musical piece data to progress from the current pitch to be played (second pitch/note) to the sound prior to the next pitch to be played thereby performing a playback of the automatic accompaniment of the current musical piece data, and then progresses to the subsequent execution of step ST44.

The processes from the subsequent execution of step ST44 to the subsequent execution of step ST48 are similar to the processes of the current execution of step ST44 to the current execution of step ST48, and thus, explanations thereof are omitted.

According to the present embodiment configured in this manner, it is possible to provide an electronic musical instrument including a lesson mode that is not too easy and not too hard, and by which a feeling of melodic intervals can be attained. Namely, in the embodiment described above, even if the performer specifies a wrong note (as the second note, for example), the automatic accompaniment does not stop as long as the wrong note is within a prescribed range from the correct note and the melodic interval direction (ascending, descending, or equal) performed by the performer is in the same direction as the actual melodic interval direction of the musical piece. As to the wrong note itself specified by the performer in such a case, the electronic musical instrument may be configured to output the wrong note(s) specified by the performer along with the automatic accompaniment even if the note(s) was wrong, or alternatively, may be configured to output the correct note(s) contained in the musical piece data instead of the wrong note(s) specified by the performer.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument, comprising:

a plurality of operation elements to be played by a performer, respectively specifying a plurality of notes of different pitches;

a memory having stored thereon a musical piece data of a musical piece, the musical piece data including data of a first note or chord that is to be played by the performer at a first timing of the musical piece, data of a second note or chord that is to be played by the performer at a second timing that follows the first timing of the musical piece, and data of a third note or chord that is to be played by the performer at a third timing that follows the second timing of the musical piece, the first through third notes or chords being included in the plurality of notes that can be specified by the plurality of operation elements, the musical piece data further including data of an accompaniment that accompanies the first, second and third notes or chords to be played by the performer; and at least one processor, wherein the at least one processor executes an accompaniment playback process that includes the following:

determining a target melodic interval direction from the first note or chord towards the second note or chord by referencing to the musical piece data, the determined target melodic interval direction being one of ascending, descending, and equal;

determining a performed melodic interval direction by referencing to an operation element or a group of operation elements, among the plurality of operation elements, that is specified by the performer at the second timing relative to an operation element or a group of operation elements, among the plurality of operation elements, that was specified by the performer at the first timing or relative to said first note or chord that was to be played by the performer at the first timing, the determined performed melodic interval direction being one of ascending, descending, and equal;

causing musical sound of the accompaniment to output based on the musical piece data from the second timing to a point in time immediately prior to the third timing only when the performed melodic interval direction matches the target melodic interval direction; and causing the musical sound of the accompaniment not to output from the second timing to the point in time immediately prior to the third timing when the performed melodic interval direction does not match the target melodic interval direction, wherein in determining the target melodic interval direction, the at least one processor compares a pitch of the second note, or a representative pitch of the second chord in case of chord, with a pitch of the first note, or a representative pitch of the first chord in case of chord, so as to determine a direction of pitch change from the first note or chord to the second note or chord in the musical piece, and wherein in determining the performed melodic interval direction, the at least one processor compares a pitch of the operation element or a representative pitch of the group of operation elements that is specified by the performer at the second timing with a pitch of the operation element, or a representative pitch of the group of operation elements, that was specified by the performer at the first timing or with the pitch of the first note, or the representative pitch of the first chord in case of chord, that was to be played at the first timing so as to determine a direction of pitch change from a note or chord that was actually specified by the performer or that should have been specified by the performer at the first timing to a note or chord that is specified by the performer at the second timing.

2. The electronic musical instrument according to claim 1, wherein the representative pitch of the chord or of the group of operation elements in each occurrence is a pitch of an averaged MIDI note number of MIDI note numbers of the corresponding chord or group of operation elements.

3. The electronic musical instrument according to claim 1, wherein the at least one processor causes the musical sound of the accompaniment to output based on the musical piece data from the second timing to the point in time immediately prior to the third timing if the performed melodic interval direction matches the target melodic interval direction and if the pitch of the operation element or the representative pitch of the group of operation elements that is specified by the performer at the second timing is within a prescribed range from the pitch of the second note, or the representative pitch of the second chord in case of chord, that was to be played at the second timing, and wherein the at least one processor causes the musical sound of the accompaniment not to output if the pitch of the operation element or the representative pitch of the group of operation elements that is specified by the performer at the second timing is not within the prescribed range from the pitch of the second note, or the representative pitch of the second chord in case of chord, that was to be played at the second timing.

4. The electronic musical instrument according to claim 1, wherein the musical piece data includes a serious of notes or chords to be successively played by the performer at prescribed timings, and the at least one processor sequentially regards three successive notes or chords and associated timings thereof as corresponding to the first to third notes or chords and the associated first to third timings, respectively, so as to sequentially perform said accompaniment playback process.

5. A method to be performed by at least one processor in an electronic musical instrument that includes, in addition to said at last one processor: a plurality of operation elements to be played by a performer, respectively specifying a plurality of notes of different pitches; and a memory having stored thereon a musical piece data of a musical piece, the musical piece data including data of a first note or chord that is to be played by the performer at a first timing of the musical piece, data of a second note or chord that is to be played by the performer at a second timing that follows the first timing of the musical piece, and data of a third note or chord that is to be played by the performer at a third timing that follows the second timing of the musical piece, the first through third notes or chords being included in the plurality of notes that can be specified by the plurality of operation elements, the musical piece data further including data of an accompaniment that accompanies the first, second and third notes or chords to be played by the performer, the method comprising, via said at least one processor:

determining a target melodic interval direction from the first note or chord towards the second note or chord by referencing to the musical piece data, the determined target melodic interval direction being one of ascending, descending, and equal;

determining a performed melodic interval direction by referencing to an operation element or a group of operation elements, among the plurality of operation elements, that is specified by the performer at the second timing relative to an operation element or a group of operation elements, among the plurality of operation elements, that was specified by the performer at the first timing or relative to said first note or chord that was to be played by the performer at the first timing, the determined performed melodic interval direction being one of ascending, descending, and equal;

causing musical sound of the accompaniment to output based on the musical piece data from the second timing to a point in time immediately prior to the third timing only when the performed melodic interval direction matches the target melodic interval direction; and causing the musical sound of the accompaniment not to output from the second timing to the point in time immediately prior to the third timing if the performed melodic interval direction does not match the target melodic interval direction, wherein in determining the target melodic interval direction, the method causes the at least one processor to compare a pitch of the second note, or a representative pitch of the second chord in case of chord, with a pitch of the first note, or a representative pitch of the first chord in case of chord, so as to determine a direction of pitch change from the first note or chord to the second note or chord in the musical piece, and wherein in determining the performed melodic interval direction, the method causes the at least one processor to compare a pitch of the operation element or a representative pitch of the group of operation elements that is specified by the performer at the second timing with a pitch of the operation element, or a representative pitch of the group of operation elements, that was specified by the performer at the first timing or with the pitch of the first note, or the representative pitch of the first chord in case of chord, that was to be played at the first timing so as to determine a direction of pitch change from a note or chord that was actually specified by the performer or that should have been specified by the performer at the first timing to a note or chord that is specified by the performer at the second timing.

6. The method according to claim 5, wherein the representative pitch of the chord or of the group of operation elements in each occurrence is a pitch of an averaged MIDI note number of MIDI note numbers of the corresponding chord or group of operation elements.

7. The method according to claim 5, wherein the method further causing, via the at least one processor, the musical sound of the accompaniment to output based on the musical piece data from the second timing to the point in time immediately prior to the third timing if the performed melodic interval direction matches the target melodic interval direction and if the pitch of the operation element or the representative pitch of the group of operation elements that is specified by the performer at the second timing is within a prescribed range from the pitch of the second note, or the representative pitch of the second chord in case of chord, that was to be played at the second timing, and wherein the method further causing, via the at least one processor, the musical sound of the accompaniment not to output if the pitch of the operation element or the representative pitch of the group of operation elements that is specified by the performer at the second timing is not within the prescribed range from the pitch of the second note, or the representative pitch of the second chord in case of chord, that was to be played at the second timing.

8. The method according to claim 5, wherein the musical piece data includes a serious of notes or chords to be successively played by the performer at prescribed timings, and the method further causes the at least one processor to sequentially regard three successive notes or chords and associated timings thereof as corresponding to the first to third notes or chords and the associated first to third timings, respectively, so as to sequentially perform said accompaniment playback process.

* * * * *